US005658176A

United States Patent [19]

Jordan

[11] Patent Number: 5,658,176

[45] Date of Patent: Aug. 19, 1997

[54] MARINE JET PROPULSION SYSTEM

[76] Inventor: Jeff P. Jordan, 3061 69th Ave. SE., Mercer Island, Wash. 98040

[21] Appl. No.: 576,891

[22] Filed: Dec. 22, 1995

[51] Int. Cl.[6] ..... B63H 11/103

[52] U.S. Cl. ..... 440/46; 440/47

[58] Field of Search ..... 440/38, 46, 47; 60/221

[56] References Cited

U.S. PATENT DOCUMENTS

| | | | |
|---|---|---|---|
| 3,214,903 | 11/1965 | Cochran | 440/47 |
| 3,279,704 | 10/1966 | Englehart et al. | 440/47 |
| 3,942,463 | 3/1976 | Johnson, Jr. | 440/47 |
| 4,373,919 | 2/1983 | Stangeland | 440/46 |
| 4,775,341 | 10/1988 | Tyler et al. | 440/38 |
| 5,244,425 | 9/1993 | Tasaki et al. | 440/47 |
| 5,338,234 | 8/1994 | Nanami | 440/38 |
| 5,401,198 | 3/1995 | Toyohara et al. | 440/47 |

FOREIGN PATENT DOCUMENTS

| | | | |
|---|---|---|---|
| 262290 | 10/1989 | Japan | 440/47 |
| 403213495 | 9/1991 | Japan | 440/47 |

*Primary Examiner*—Sherman Basinger
*Attorney, Agent, or Firm*—Robert M. Storwick

[57] ABSTRACT

An improved water jet propulsion system for a jet propelled watercraft is disclosed designed to operate more efficiently. The improved propulsion system includes an adjustable water inlet duct, a larger pump, and an adjustable discharge nozzle. The inlet duct includes a hydraulically efficient inlet tunnel with an adjustable entrance opening which adjust in size according to the velocity of the water-craft in the body of water and the flow of water through the system. Using the inlet tunnel and the adjustable grate structure, the total dynamic head of the incoming water may be recovered at the pump. The pump is larger than typical pumps used on jet propulsion systems so that a greater flow of water at low head pressure may be delivered to the adjustable discharge nozzle. The adjustable feature on the discharge nozzle enables the flow through the system to be adjusted so that the hydraulic conditions on the pump are maintained at all boat speeds and all shaft rpm.

11 Claims, 4 Drawing Sheets

72
49
78
49
66
79
77
76
74
75
80

MARINE JET PROPULSION SYSTEM

BACKGROUND OF THE INVENTION

1. Field of the Invention

This invention relates to marine jet propulsion systems and, more particularly, to improved marine jet propulsion systems designed to operate more efficiently.

2. Description of the Related Art

A typical marine jet propulsion system includes an inlet duct, a pumping means, and a nozzle. The inlet duct delivers water from under the hull to a low volume, high speed pumping means which is coupled to a gasoline powered, internal combustible engine. The pumping means forcibly delivers the water through the nozzle thereby propelling the water craft through the body of water in which the water craft moves.

Heretofore, high revolution, gasoline powered engines have been used in marine jet propulsion systems due to their lower costs, the availability of a wide variety of different horsepowers, their ability to be directly connected to a pumping means and to provide sufficient high RPM required by the pumping means. Due to the relatively high RPM produced by these engines, high speed pumping means are commonly used in such systems. Unfortunately, these high speed pumping means operate most efficiently when a small volume of water under relatively high pressure is delivered thereto. Because only a relatively small amount of water is required by these pumping means, water craft manufacturers, heretofore, have not been concerned with the size or the efficiencies of the inlet duct.

One goal of manufacturers in the marine jet propulsion system industry is to develop jet propulsion systems which are more efficient and provide improved performance and fuel economy. In the prior art, it has been generally accepted that the highest propulsion efficiency for a propulsion system is achieved when a large mass of water is accelerated a very small increment of velocity. In order to achieve high propulsion efficiency with jet propulsion systems, large pumping means and large diameter nozzles must be used. Unfortunately, the manufacturers in the industry have not been able to overcome the increased hydraulic inefficiencies which develop in the large pumping means, large nozzles, and inlet ducts which offset any gains in propulsion efficiency. An improved marine jet propulsion system which uses a large pumping means and a large nozzle to achieve greater propulsion efficiency and which overcomes the hydraulic inefficiencies in the pumping means, nozzle and inlet duct would be very desirable.

SUMMARY OF THE INVENTION

It is an object of the invention to provide an improved marine jet propulsion system which uses large pumping means and large diameter nozzle to achieve higher propulsion efficiency than currently available marine jet propulsion systems.

It is another object of the invention to provide such a system wherein the gain in propulsion efficiency is not offset by increased hydraulic inefficiencies in the pumping means, nozzle and inlet duct.

It is a further object of the invention to provide such a system which can be dynamically adjusted to hold efficient hydraulic conditions on the pumping means, discharge nozzle and inlet duct at all boat speeds.

These and other objects are met by providing an improved water jet propulsion system for a water craft comprising an efficient, incoming water head recovery inlet duct, a large pumping means and a large, adjustable discharge nozzle. By using an efficient inlet duct, a large pumping means, and a large adjustable discharge nozzle, the propulsion efficiency of the entire system is greatly improved over jet propulsion systems typically found in the prior art.

In order to use in combination a large pumping means and a large adjustable discharge nozzle, an improved inlet duct must be used which enables the pumping means to efficiently recover the total dynamic head of the large flow required by the large pumping means. In the embodiment disclosed herein, the inlet duct includes a grate structure located over the entrance of a hydraulically efficient, elongated inlet tunnel formed in or attached to the bottom of the water craft's hull. The inlet tunnel is longitudinally aligned on the hull with a front entrance opening and a rear exit opening. The inlet tunnel has a smooth outer surface which curves upward inside the hull with a wider cross-sectional area at its rear exit opening than at its front entrance opening. The grate structure includes an adjustment means which automatically adjusts the size of the entrance opening of the inlet tunnel so that the velocity of the incoming water therethrough matches the velocity of the water craft in the body of water 95 in which the water craft moves. By controlling the velocity of the incoming water through the entrance opening and by using a hydraulically efficient inlet tunnel, the total dynamic head of the incoming water may be recovered at the inlet tunnel's exit opening where a pumping means is located.

The pumping means can operate at its best efficiency flow producing additional head for propulsion. The combined total head, delivered to the discharge nozzle, is equal to the total dynamic head recovered at the pumping means plus the head produced by the pumping means itself.

In order for the pumping means to constantly operate at its most efficient rate, the discharge nozzle includes a nozzle adjustment means for controlling the size of the discharge nozzle according to the flow through the system and the pressure differential between the total dynamic head of the incoming water recovered at the pumping means and the total dynamic head of the water leaving the pumping means. By controlling the size of the discharge nozzle in this manner, the rate of flow of incoming water through the inlet duct, the pumping means and the discharge nozzle can be constantly maintained during operation so that the pumping means operates at its most efficient rate for its shaft speed.

DESCRIPTION OF THE PREFERRED EMBODIMENT

Figure 1:
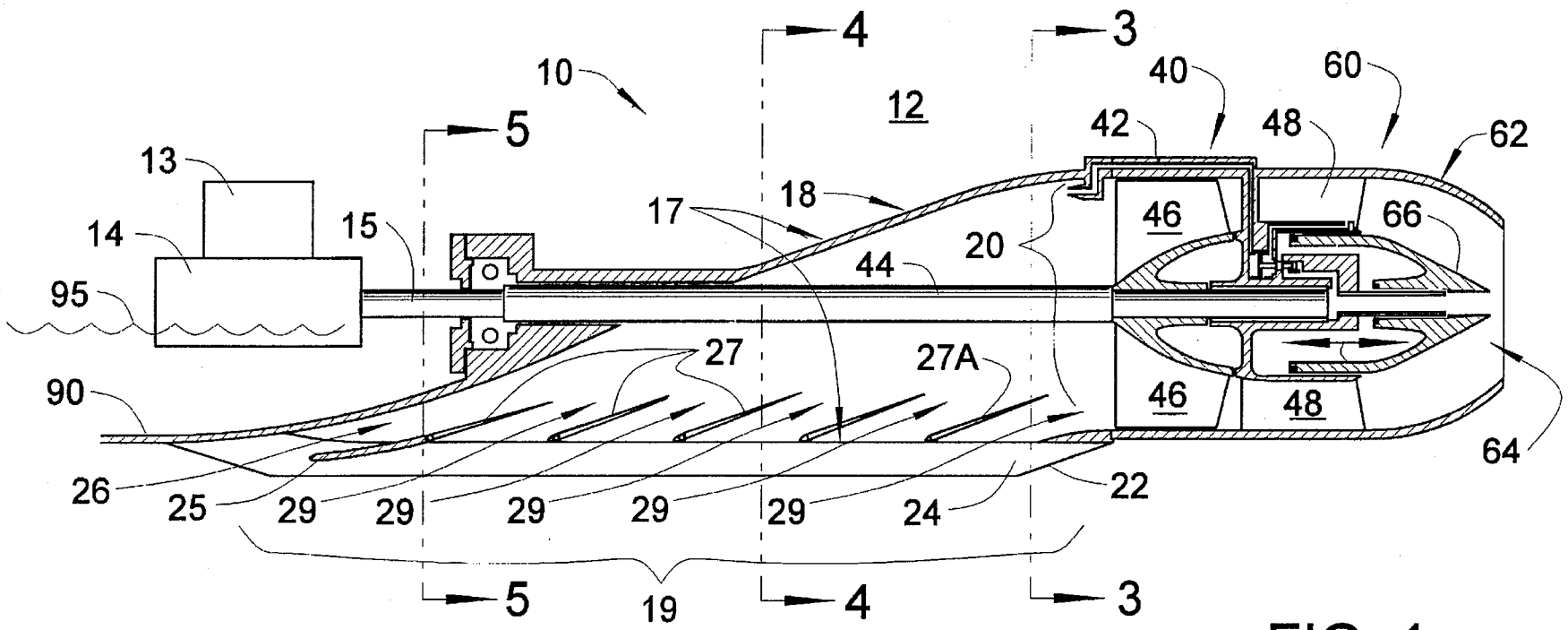
FIG. 1 is a side elevation view of a watercraft showing the improved marine jet propulsion system used therein.

In the accompanying FIGS. 1–7, there is shown an improved marine jet propulsion system, generally referred to as 10, designed to achieve higher propulsion efficiency than currently available marine jet propulsion systems.

The system 10 includes an articulating water inlet duct 17 for admitting water into the system 10, a large pump 40 capable of receiving and pumping a relatively large amount of incoming water, and an adjustable, large diameter discharge nozzle 60 capable of forcibly exiting the water pumped by the pump 40 to propel the watercraft 89 through the body of water 95. By using a large pump 40 and a large diameter discharge nozzle 60, the propulsion efficiency of the system 10 is greatly improved over marine jet propulsion systems typically found in the prior art.

The inlet duct 17 is designed so that hydraulic efficiency of the system 10 is optimally maintained at all watercraft 89 velocities. This goal is achieved by using a novel inlet duct 17 which includes an inlet tunnel 18 with varying cross-sectional shape from the fore to the aft positions and by controlling the effective area of the entrance opening 19 to the inlet tunnel 19 so that the velocity of the water entering the inlet tunnel 19 matches the velocity of the watercraft 89 in the body of water 95.

It is well known in the turbine and venturi flow meter art fields that for efficient pressure recovery in an inlet duct, five conditions must be met: (1) the hydraulic radius of the flow lines approaching the entrance opening of the duct must be kept large relative to the flow cross-section in order to minimize losses due to turbulence; (2) the effective vane entrance angles must match the angle of the relative velocity vector approaching the inlet duct, commonly called the angle of approach; (3) the velocity of the fluid flowing just inside the inlet duct must match the velocity of the fluid approaching the entrance of the inlet duct; (4) the change in cross-section area between the entrance opening and exit opening of the inlet duct must be gradual and proceed at a nearly constant rate in order to minimize the formation of swirls or eddies; and, (5) the hydraulic radius within the duct must be kept large relative to the flow cross-section. The inlet duct 17, disclosed herein is designed to meet these conditions.

As shown in FIGS. 1–5, the inlet duct 17 includes an adjustable grate structure 22 located over the entrance opening 19 of the hydraulically efficient, elongated inlet tunnel 18 formed or attached to the bottom of the watercraft's hull 90. The inlet tunnel 18 is longitudinally aligned on the hull 90 with a front entrance opening 19 and a rear exit opening 20. The inlet tunnel 18 gently curves upward inside the hull 90 and has a wider cross-sectional area at its exit opening 20 than at its entrance opening 19. The surrounding surface of the entrance opening 19 of the inlet tunnel 18 is gently curved from tangent to the hull 90 of the watercraft 89 so that turbulence is minimal.

The grate structure 22 includes an adjustment means which automatically adjusts the size of the entrance opening 19 so that the velocity of the incoming water therethrough matches the velocity of the watercraft 89 in the body of water 95 in which the watercraft 89 moves. By controlling the velocity of the incoming water through the entrance opening 19 and by using a hydraulically efficient inlet tunnel 18 having a shape which gradually increases in cross-sectional area between its entrance opening 19 to its exit opening 20, the dynamic head of the incoming water may be efficiently recovered at the pump 40.

Figure 2:
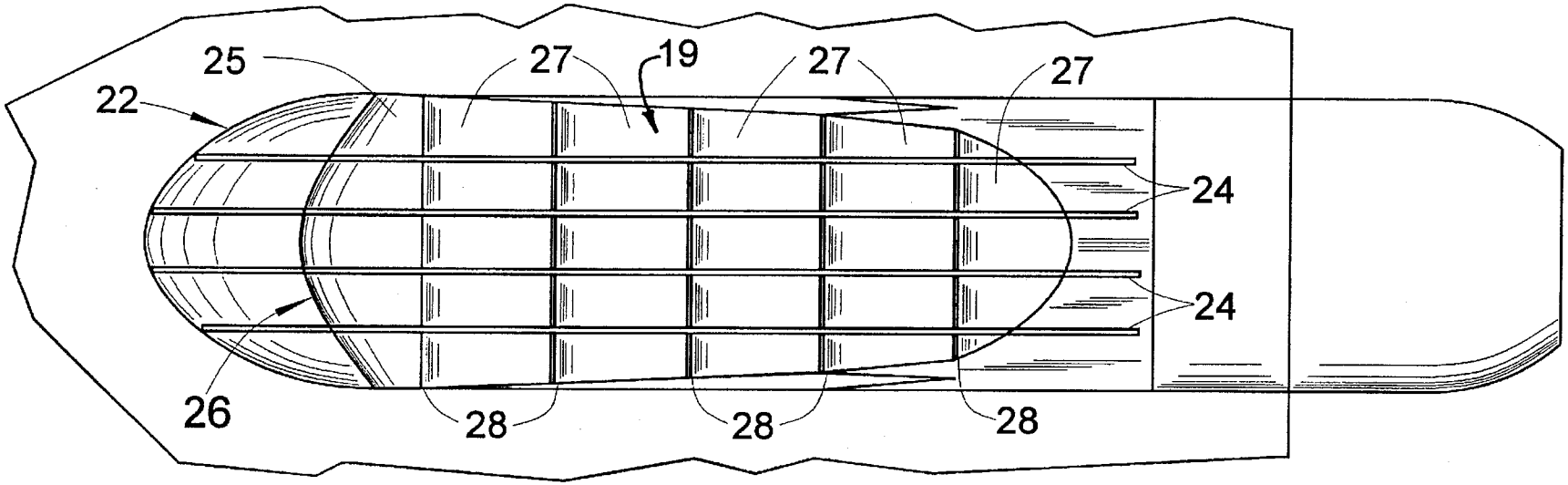
FIG. 2 is a bottom plan view of the inlet duct.
Figure 3:
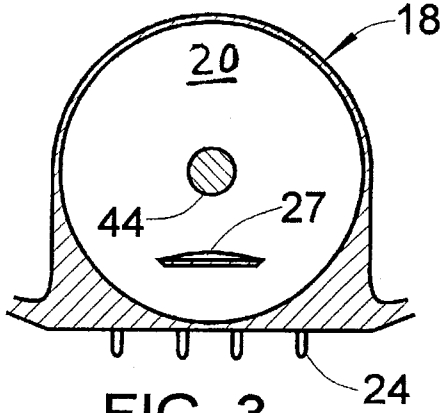
FIG. 3 is a sectional, end elevational view of the inlet tunnel region taken along line 3—3 in FIG. 1.
Figure 4:
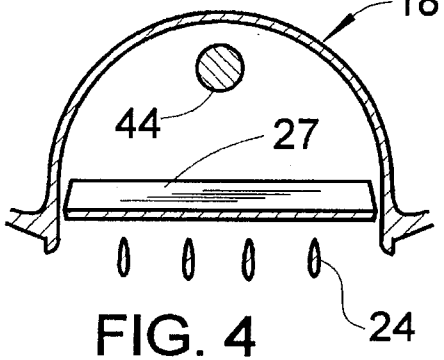
FIG. 4 is a sectional, end elevational view of the inlet tunnel region taken along line 4—4 in FIG. 1.
Figure 5:
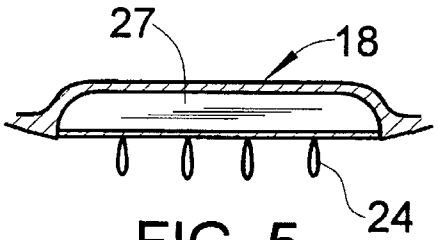
FIG. 5 is a sectional, end elevational view of the inlet tunnel region taken along line 5—5 in FIG. 1.
Figure 6:
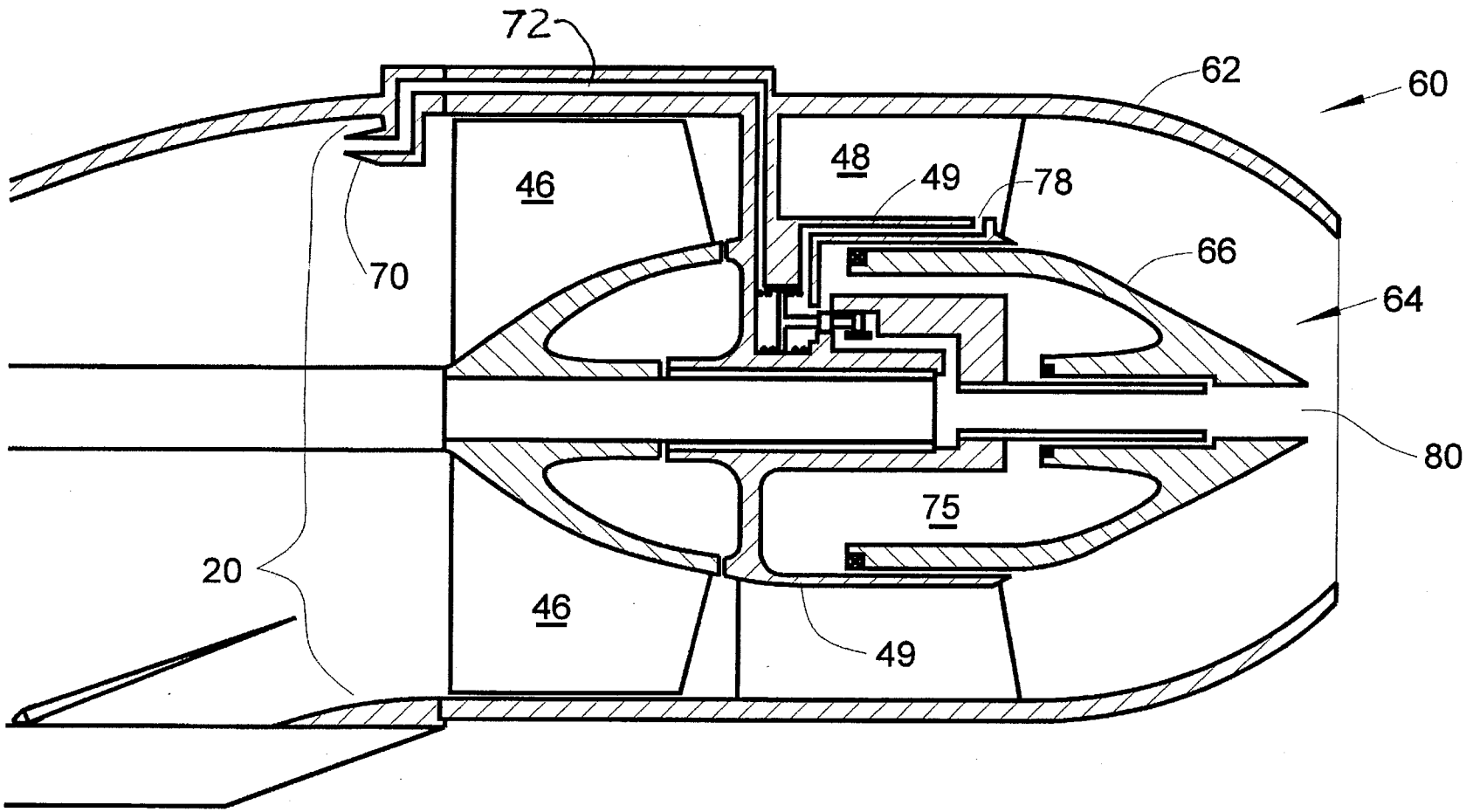
FIG. 6 is a partial, side elevational view of the system showing the needle in a retracted position in the discharge nozzle.

As shown in FIGS. 1–2, the grate structure 22 includes a plurality of spaced apart, longitudinally aligned elongated members 24, one transversely aligned fixed vane 25, and a plurality of spaced apart, transversely aligned floating vanes 37. A first inlet opening 26 is created between the transitional region 23 of the grate structure 22 and the fixed vane 25. The floating vanes 27 are pivotally attached along their leading edges 28 to the elongated members 24. The floating vanes 27 are spaced apart and aligned over the elongated members 24 so that an adjustable inlet openings 29 are created between adjacent floating vanes 27. The fixed and floating vanes 25, 27, respectively, are aligned so they extend upward and rearward into the inlet tunnel 18.

The leading edges of the fixed vane 25 and the floating vanes 27 span the width of the inlet tunnel 18 while the lateral edges thereof fit closely to the adjacent, inside surface of the inlet tunnel 18 in the closed position. The front and rear planar surfaces of the fixed vane 25 and the floating vanes 27 recede from the leading edge 28 to create a hydraulically effective angle. This angle follows the flow line to approximately match the velocity of approach of the flow of water entering into the inlet duct 17.

When the watercraft 89 is stationary or at low speed, water enters the grate structure 22 via the suction created by the pump 40. During this stage, the entrance opening 19 is wide open so that all of the floating vanes 27 conform to the stream lines of water flow and acting as diffusers to reduce swirl. As the watercraft's speed increases, water enters the grate structure 22 by the forward movement of the watercraft 89 through the body of water 95 and by the suction of the pump 40. All of the floating vanes 27 pivot freely to an opened position by aligning in a rearward, diagonally aligned position by the flow of the incoming water. During this stage, the head on the incoming water is partially recovered at the pump 40. As the watercraft 89 increases its speed, the entrance opening 19 begins to close. As the velocity of the incoming water through the grate structure 22 increases, the flow lines through the grate structure 22 become more widely spaced. The aft-most floating vane, denoted 27A, rides on the flow until it eventually closes against the grate structure 22. At this point, the leading edge of the floating vane 27A acts as the entrance edge of the entrance opening 19 and pressure begins to build along the gradually increasing cross-sectional area between this newly created entrance opening and the pump's impeller 46.

As the velocity of the incoming water at the entrance opening 19 relative to the velocity of the incoming water at the exit opening 20 in the inlet tunnel 18 increases, the flow lines progressively close the remaining floating vanes 27 from the aft to the fore positions. It can be seen that this has two effects —first, it reduces the effective area of the entrance opening 19 of the inlet tunnel 18; and second, it increases the effective length of the inlet duct 17. It can also be seen that the angle of approach of the streamline is always approximately aligned with the entrance angle of the vane which forms the entrance to the inlet duct 17, which is well known in the art as a design requirement for high efficiency in turbines and pumps. Further it can be seen that the changes both in cross-sectional area and in flow direction within the inlet tunnel 18 are always gradual, which are design requirements well known in the art for the efficient recovery of pressure head in the turbines and venturi flow meters. Finally, it can be seen that the increasing effective length of the inlet tunnel 18 with decreasing effective entrance opening 19 maintains a nearly constant rate of change in area over the inlet tunnel's range of operation and provides the necessary length of efficient recovery of pressure head at every stage. The total dynamic head of the incoming water can then be recovered at the pump 40.

Disposed adjacent to the exit opening 20 of the inlet tunnel 18 is the pump 40 which is coupled via a transmission 14 to an engine 13. In the embodiment shown, the pump 40 is contained in a pump housing 42 attached to or formed integrally with the inlet tunnel 18. The pump 40 is axially aligned with the exit opening 20 so that the pump shaft 44 extends forward therefrom and connects to the transmission 14. In the embodiment shown, the pump 40 includes an impeller 46 which rotates to forcibly deliver the incoming water from the exit opening 20 to the discharge nozzle 60 located on the opposite side of the pump 40. The size of the pump 40 is determined by the size of the discharge nozzle and the type and size of watercraft 89. The size of the pump 40 is limited by the space in the watercraft 89 and the production costs. In the preferred embodiment, the pump 40 is designed to be used with a 200 horsepower engine so that the mass flow equals approximately 1500 lbs/sec and the pump head is approximately 75 feet. The pump 40 uses a 14 inch impeller 46 which matches the size of the outer housing 62 on the discharge nozzle 60 designed to form a 7½inch effective nozzle opening 44. A diffuser 48 is disposed over the aft position of the pump 40 to recover the forced vortex produced by the pump 40.

The 14 inch impeller 46 must operate at about 2070 RPM to meet the head and flow requirements of the discharge nozzle. Unfortunately, this is too fast to avoid cavitation at low boat speeds with partial recovery of incoming dynamic head. This size of impeller 46 is able to operate close to full power, however, once the effective submergence reaches 14 feet at 30 FPS (20 mph). The impeller 46 is still cavitating under these conditions, and this cavitation would destroy the impeller 46 in a few months of continuous service, but it has very little effect on efficiency. The fact that the impeller 46 cavitates at speeds below 20 mph at full power, is balanced by the transient nature of that service.

Located at the aft position to the pump's diffuser 48 is the discharge nozzle 60 which includes an outer nozzle housing 62 with a retractable needle 66 disposed therein. The needle 66 is longitudinally aligned inside the diffuser's hub 49 and moves axially therein to adjust the size of the effective nozzle opening 64.

A nozzle adjustment means is connected to the discharge nozzle 60 for controlling the size of the effective nozzle opening 64, and hence the rate of flow of water through the system 10. As shown in FIGS. 6 and 7(A)–(C), the nozzle adjustment means includes a pitot tube 70, a pressure conduit 72, a spool control valve 74 and inner chamber 75 disposed between the needle 66 and the hub 49. The port opening on the pitot tube 70 is disposed in a fore position to the pump's impeller 46 and is connected to the spool control valve 74 via the pressure conduit 72. The spool control valve 74 includes a piston 76 disposed inside a small inner cylinder 77 located in the hub 49. The operation of the nozzle adjustment means to control the flow of water through the system 10 is discussed further below.

The system efficiency is the product of three components, inlet duct, pump and nozzle. The last can be taken as a constant of about 97%, leaving only duct and pump efficiency as design considerations. The two are independent in that duct efficiency does not affect pump efficiency and pump efficiency does not affect duct efficiency. Both affect system efficiency. However, the flow variations caused by the inlet duct recovery of head result in inefficient pump operation, if the flow is not corrected by nozzle area adjustments.

The head on the nozzle is the sum of the pump head and the inlet duct head. The flow through the nozzle increases as the effective area of the nozzle increase and as the square root of the head on the nozzle increases. If the flow increases due to increased head, it can be reduced by reducing the nozzle area. This is useful, because the flow must be constant for any given shaft rpm to maintain efficiency. For example, pump efficiency at full power shaft rpm requires the same flow, regardless of the head recovered in the inlet duct, which can be seen in the following.

The efficiency of the pump is a function of flow and shaft rpm. According to the widely used pump affinity relationships for any and all pumps, the best efficiency is obtained when flow Q divided by rpm N equals the constant characteristic of the pump design ($Q/N=K_Q$).

A pump's operating efficiency point has three coordinates: rpm N, flow Q and head h. Any two determine the third. In this discussion, the pump's best efficiency operating point is the particular operating point of interest. The determining affinity equations are $Q=K_z N$ and $h=K_h N^2$, wherein $K_h$ is the head constant characteristic of the pump design. From the above, it is quickly apparent from substitution that $h=K_h (Q/K_z)^2$. When this hydraulic condition is met, the pump is operating at its best efficiency.

Operation of the Invention

When the boat is stationary or moving at very low speed, no pressure is recovered in the inlet duct 17 and the pump 40 is operating in a suction mode. All of the floating vanes 27 in the inlet duct 17 are in an open position and act to diffuse the flow of water therein. The balance of forces moves the piston 76 to the forward position. The needle 66 is fully retracted in the outer housing 62. The effective nozzle opening 64 is then at a maximum. The pump's impeller 46 and discharge nozzle 60 are designed so that the pump 40 operates at less than peak efficiency flow under this condition. This nozzle restriction reduces both the flow and the hydraulic efficiency of the pump 40, which produces higher head and demands more power from the engine 13. The power is readily available because the engine 13 can supply substantial power in excess of the cavitation limit of the pump 40. Part of the power that would have been consumed during cavitation is lost to the lower hydraulic efficiency of the pump 40, but the reduced-flow operation has the net effect of maximizing the hydraulic power delivered by the pump 40 to the discharge nozzle 62. As a result, the small effective nozzle opening produces greater thrust than would be produced by a larger effective nozzle opening, which would be required to maintain the pump's peak hydraulic efficiency in the absence of cavitation.

As the water craft's speed increases, the inlet duct 17 recovers part of the available dynamic head and becomes fully effective when the velocity of the watercraft 89 reaches approximately 30 feet per second (20 mph). At this velocity, the flow of the water exiting the inlet duct 17 matches the velocity of the water entering the inlet duct 17. This velocity is typically the peak hull drag at its greatest wave making losses as the boat is coming up on plane. At this velocity, the inlet duct 17 recovers about 14 feet of total dynamic head at the pump's impeller 46. This head is effective submergence of the pump 40 and acts to suppress cavitation. The 14 feet of total dynamic head is also additive to the pump head at the pump's most efficient operation, such operation now being free of cavitation under 14 feet of effective submergence. These hydraulic conditions allow full power operation with cavitation losses. The inlet duct 17, the pump 40, and the discharge nozzle 60 are now operating at maximum efficiency at any shaft power up to full design power.

The total dynamic head of the incoming water in the inlet tunnel 18 at the exit opening 20 is converted to pressure in the pitot tube 70, as is well known in the art. This pressure acts through the pressure conduit 72 on the piston 76 in the spool control valve 74 to produce a motive force. The pressure component of the total dynamic head after the pump 40 is then delivered through the pressure port 78 on the hub 49 which creates a motive force on the inside surface of the piston 76 located in the inner chamber 77. The design is such that these two forces exerted on the piston 76 are in balance whenever the pump 40 is operating at best efficiency.

Figures 7A, 7B, 7C:
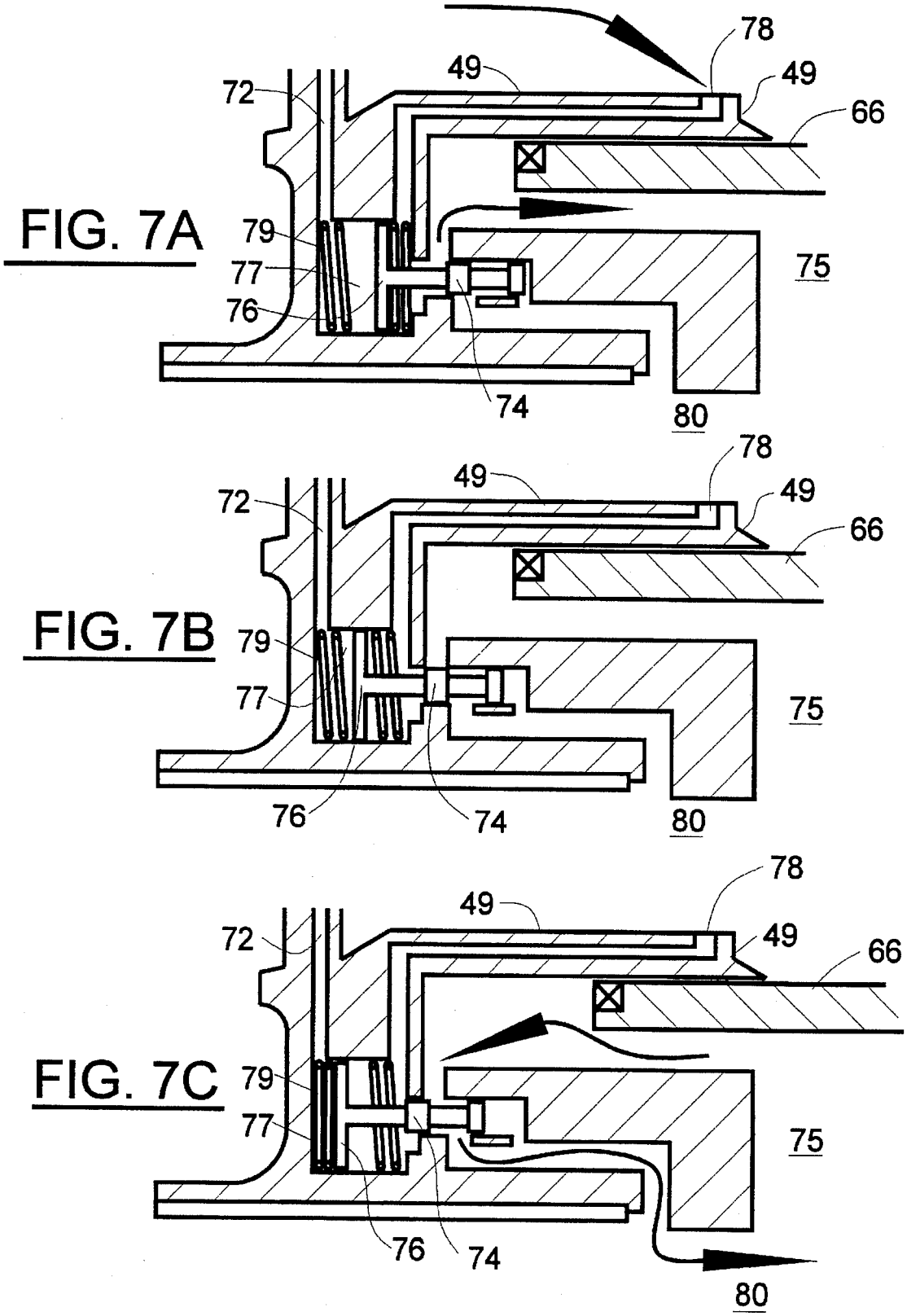
FIGS. 7(A)–(C) are illustrations showing the movement of the needle in response to the fluid flow around the needle and the chamber.

If the flow f(1) is too high for the head being produced by the pump 40, the net motive force on the piston 76 moves the spool control valve 74 to allow water from the pressure port 78 to flow from the piston chamber 77 and into the needle's inner chamber 75, which advances the needle 66, as shown in FIG. 7A. This, of course, reduces the effective area of the nozzle opening 64 and reduces the flow therethrough. With the reduction of flow through the nozzle opening 64, the forces exerted on the opposite sides of the piston 76 are balanced which, in turn, causes the spool control valve 74 to move back into a neutral position so that no water flows either into or out of the piston chamber 75 as shown in FIG. 7B. A biasing spring 79 disposed inside the piston chamber 77 is used to make the spool control valve 74 movement proportional to the net motive force on the piston 76, and this provides stable operation, as is well known in the art.

If the flow f(1) is two low, the net motive force on the piston 76 acts to move the spool control valve 74 in a forward direction, which compresses the biasing spring 79 as shown in FIG. 7C. When sufficient force is exerted on the piston 76, the spool control valve 74 opens the piston chamber 77 to the drain 80, thereby allowing the water in the piston chamber 77 to flow f(5) into the drain 80. The pressure in the outer housing 62 acts against the outer face of the needle 66 to force the needle 66 longitudinally back into the hub 49. This movement forces the water from the inner chamber 75 and into the drain 80. As the needle 66 retracts, the effective nozzle opening 64, and hence the flow f(1), increases until the motive force on the piston 76 and biasing spring 79 again returns the spool control valve 74 to its neutral position as shown in FIG. 7B.

As one can see, the needle 66 adjusts so that the pump 40 operates at its optimal efficiency, regardless of the total dynamic head in the inlet duct 17 or the shaft power. Similarly, the inlet duct 17 can be seen to effectively recover the total dynamic head at any watercraft 89 speed greater than the design minimum and any pump shaft power less than the design maximum, because the effective area of entrance opening area of the inlet duct 17 must be reduced with either higher velocity or lower power.

As mentioned above, the floating vanes 27 on the inlet duct 17 ride on the flow lines of the water flow field in the inlet duct 17. Such flow fields, composed of stream lines and pressure isobars perpendicular thereto, are well known in the art of pump and turbine designs. In the absence of the floating vanes 27, the flow of water into the middle of the inlet duct 17 would be rejected out of the back of the inlet duct 17 and this loss of flow could be seen to increase with increase velocity of the watercraft 89 and decrease the pump's shaft power. This outflow at the back of the inlet duct 17 is the major source of inlet duct inefficiency in the prior art.

In the invention disclosed herein, the anterior floating vane 27A prevents this outflow when the flow line carries it up against the grate structure 22 which prevents it from releasing the flow. The flow, thus trapped above the anterior floating vane 27A, acts fully against the impeller 46, and the inlet duct 17 is now defined by the leading edge of the aft vane, denoted 27A. It can be seen that the area of the inlet duct 17 is effectively reduced by the closing of this vane, because its leading edge forms a smaller duct opening than does its trailing edge due to the incline geometry of the inlet duct.

As the watercraft 89 approaches top speed at the full power required to overcome hull drag, all of the floating vanes 27 in the inlet duct 17 are closed by the flow across the cross-section area of the first inlet opening 26, which becomes the total system flow at the relative velocity of the water across the area of the fixed inlet.

At top speed, it can also be seen that the needle 66 will be fully extended to reduce the effective nozzle opening 64, as both of the conditions for the minimal nozzle opening 64 are at a maximum, namely: pressure recovery in the inlet duct 17 and the pump shaft power.

In the preferred embodiment discussed above, the system 10 can also be seen to operate efficiently at the water craft's planing velocity of approximately 45 feet per second. At this velocity, the inlet duct 17 recovers approximately 30 feet of total dynamic head at the pump's impeller 46. With the reduced hull drag at the typical hull's most efficient planing velocity, the required pump shaft power is reduced to approximately 25% of maximum. The low shaft power at this watercraft velocity requires reduction of flow for efficient pump operation, and the needle 66 is fully extended to reduce the effective nozzle opening 64. The pump 40 is operating under conditions which are suitable for long term commercial operation in accordance with the standards of the Pump Institute. Commercial pumps of this size commonly achieve efficiencies in the range of 85–89% under these conditions.

If the shaft power is increased rapidly to full power, the effective nozzle opening 64 will increase to allow the higher flow required by the pump 40 at the higher shaft power. The rate of change is limited by the flow from the piston chamber 75 to the drain 80 via the spool control valve 74. The inertia of the engine and transmission limit the rate of change of the shaft speed, and the increased nozzle pressure caused by a lag in the needle 66 response acts to increase the rate of correction, both of which are natural stabilizing effects to the control response. The inlet duct 17 will independently open to supply the greater system flow and will still recover the same 30 feet of total dynamic head against the impeller 46, except that the velocity component will be higher and the pressure component correspondingly lower.

From this, it can be seen that the inlet duct 17 and the discharge nozzle 62 are able to simultaneously maintain efficient recovery of the power in the relative velocity of the water, efficient operation of the pump 40, and high propulsion efficiency characteristic of the large nozzle over all velocities above 30 fps and over all pump shaft power levels above what is required to overcome hull drag.

It can also be seen that the combined use of the inlet duct 17 and the discharge nozzle 60 require a larger range of action in each than would be required if the inlet duct 17 or discharge nozzle 60 were used singularly. For example, the entrance area of the inlet duct 17 must be largest at low watercraft velocities when the effective nozzle opening 64 is at its maximum setting. The entrance area of the inlet duct 17 must be smallest at high watercraft velocities and when the effective nozzle opening 64 is at its minimum setting.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An improved water jet propulsion system for a jet propelled watercraft, comprising;

a) an adjustable water inlet duct capable of delivering water to said system, said inlet duct includes a hydraulically efficient inlet tunnel having an entrance opening and an exit opening, said entrance opening having an adjustment means capable of adjusting the size of said entrance opening so that the velocity of water through said entrance opening matches the velocity of the watercraft in the body of water in which it moves;

b) a pumping means disposed adjacent to said exit opening on said inlet tunnel, said pumping means capable of receiving and pumping the water from said inlet duct and forcibly delivering the water through said system to propel said watercraft through the body of water in which said watercraft is operating; and, c) a discharge nozzle with an adjustable effective nozzle opening, said discharge nozzle capable of receiving and forcibly expelling water from said pumping means to propel said watercraft in said body of water, said discharge nozzle including means for adjusting said effective nozzle opening of said discharge nozzle so that the optimal efficiency of said pumping means is maintained during operation.

2. An improved water jet propulsion system as recited in claim 1, wherein said discharge nozzle includes an outer housing and a needle disposed therein capable of moving longitudinally to adjust the size of said effective nozzle opening on said discharge nozzle.

3. An improved water jet propulsion system as recited in claim 2, wherein said means for adjusting said effective nozzle opening adjusts in response to the amount of pressure produced by said pumping means and the amount of water flowing through said system.

4. An improved water jet propulsion system as recited in claim 3, wherein said means for adjusting said effective nozzle opening includes said pumping means having a spool control valve that responds to the differential in total pressure before said pumping means and the static pressure of the water flow leaving said pumping means to control the size of said effective nozzle opening.

5. An improved water jet propulsion system as recited in claim 1, wherein said inlet tunnel is longitudinally aligned on said watercraft.

6. An improved water jet propulsion system as recited in claim 5, wherein said adjustment means capable of adjusting the size of said entrance opening includes an adjustable grate structure disposed over said entrance opening, said grate structure having a plurality of transversely aligned floating vanes, each said floating vane being pivotally attached to enable said floating vane to move according to the flow of water entering said inlet duct, thereby reducing the size of said entrance opening and increasing the length of said inlet duct.

7. An improved water jet propulsion system for a jet propelled watercraft, comprising:

a) an adjustable inlet duct enabling water to enter the jet propulsion system, said inlet duct including an inlet tunnel having an entrance opening and an exit opening;

b) an adjustable discharge nozzle enabling water to exit the jet propulsion system, said adjustable discharge nozzle includes an outer housing and a needle disposed therein capable of moving longitudinally to adjust the size of the effective nozzle opening on said discharge nozzle;

c) a pumping means disposed between said adjustable inlet duct and said adjustable discharge nozzle capable of efficiently receiving and pumping water entering said jet propulsion system through said adjustable inlet duct and forcibly delivering said water through said adjustable discharge nozzle to propel the watercraft through the body of water in which the watercraft is operating;

d) an adjustment means connected to said adjustable discharge nozzle for adjusting the size of said adjustable discharge nozzle in response to the amount of pressure and flow of water on said pumping means, said adjustment means including a control valve that responds to the differential in water flow before said pumping means and the water flow leaving said pumping means to control the size of said effective nozzle opening; and, e) an adjustment means capable of adjusting the size of said entrance opening capable of adjusting the size thereof in response to the relative velocity of the watercraft in the body of water and the amount of water exiting said adjustable discharge nozzle, said entrance opening adjustment means including an adjustable gate structure disposed over said entrance opening, said gate structure having at least one transversely aligned fixed vane and a plurality of transversely aligned floating vanes, said floating vanes being pivotally attached so that said floating vanes move according to the flow of water entering said inlet duct.

8. An improved water jet propulsion system as recited in claim 7, wherein said inlet tunnel is longitudinally aligned on said watercraft with said exit opening having a wider cross-sectional area than said entrance opening.

9. An improved water jet propulsion system for a jet propelled watercraft, comprising:

an adjustable water inlet duct capable of delivering water to said system, said inlet duct including a hydraulically efficient inlet tunnel having an entrance opening and an exit opening, said entrance opening including adjustment means for adjusting the size of said entrance opening so that the velocity of water through said entrance opening matches the velocity of the watercraft in the body of water in which it moves;

pumping means disposed adjacent to said exit opening on said inlet tunnel and adapted to receive water from said inlet duct, said pumping means being for pumping the water from said inlet duct and for delivering the water through said system, thereby propelling said watercraft through the body of water in which said watercraft is operating; and a discharge nozzle with an adjustable effective nozzle opening, said discharge nozzle being adapted to receive said water from said pumping means and to forcibly expel said water to propel said watercraft in said body of water, said discharge nozzle including means for adjusting said nozzle opening of said discharge nozzle so that the optimal efficiency of said pumping means is maintained during operation and to forcibly expel water, said discharge nozzle including an outer housing and a needle disposed therein, said needle being capable of moving longitudinally to adjust the size of said effective nozzle opening on said discharge nozzle, said means for adjusting said effective nozzle opening adjusting in response to the amount of pressure produced by said pumping means and the amount of water flowing through said system, said means for adjusting said effective nozzle opening including said pumping means having a spool control valve that responds to the difference between the water flow before said pumping means and the water flow leaving said pumping means to control the size of said effective nozzle opening.

10. A watercraft, comprising:

a hull;

an engine located in the hull;

and a water jet prolusion system connected to the engine, the water jet propulsion system including:

an adjustable water inlet duct to deliver water to said system, said inlet duct includes a hydraulically efficient inlet tunnel having an entrance opening and an exit opening, said entrance opening having an adjustment device to adjust the size of said entrance opening so that the velocity of water through said entrance opening matches the velocity of the watercraft in the body of water in which it moves, a pump connected to the engine and disposed adjacent to said exit opening on said inlet tunnel, said pump being adapted to receive water from said inlet duct and to forcibly deliver the water through said system to propel said watercraft through the body of water in which said watercraft is operating, and a discharge nozzle with an adjustable effective nozzle opening, said discharge nozzle being adapted to receive and forcibly expel water from said pump to propel said watercraft in said body of water, said discharge nozzle including an adjustment mechanism to adjust said effective nozzle opening of said discharge nozzle so that the optimal efficiency of said pump is maintained during operation of the water jet propulsion system.

11. A method for propelling a watercraft, comprising the steps of:

a) providing an adjustable water inlet duct capable of delivering water to a propulsion system, the inlet duct including a hydraulically efficient inlet tunnel having an entrance opening and an exit opening, the size of said entrance opening being adjustable so that the velocity of water through the entrance opening matches the velocity of the watercraft in the body of water in which it moves;

b) providing a pumping means disposed adjacent the exit opening on the inlet tunnel and adapted to receive water from said inlet duct, the pumping means being adapted to pump the water from the inlet duct and for delivering the water through the propulsion system, thereby propelling said watercraft through the body of water in which said watercraft is operating; and c) providing a discharge nozzle with an adjustable effective nozzle opening, said discharge nozzle being adapted to receive said water from said pumping means and to forcibly expel said water to propel said watercraft in said body of water, said discharge nozzle including means for adjusting said nozzle opening of said discharge nozzle to forcibly expel water, said discharge nozzle including an outer housing and a needle disposed therein, said needle being capable of moving longitudinally to adjust the size of said effective nozzle opening on said discharge nozzle, said means for adjusting said effective nozzle opening adjusts in response to the amount of pressure produced by said pumping means and the amount of water flowing through said system, said means for adjusting said effective nozzle opening including said pumping means having a spool control valve that responds to the difference between the total pressure before said pumping means and the static pressure of the water flow leaving said pumping means to control the size of said effective nozzle opening; and d) adjusting the inlet duct and the discharge nozzle so that the pumping means is operated at optimal efficiency when propelling the watercraft.

* * * * *